US008291877B2

(12) United States Patent
Meintschel et al.

(10) Patent No.: US 8,291,877 B2
(45) Date of Patent: Oct. 23, 2012

(54) VALVE DRIVE DEVICE

(75) Inventors: Jens Meintschel, Bernsdorf (DE); Thomas Stolk, Kirchheim (DE); Alexander Von Gaisberg-Helfenberg, Beilstein (DE)

(73) Assignee: Daimler AG, Stuttgart (DE)

( * ) Notice: Subject to any disclaimer, the term of this patent is extended or adjusted under 35 U.S.C. 154(b) by 365 days.

(21) Appl. No.: 12/800,807

(22) Filed: May 21, 2010

(65) Prior Publication Data

US 2010/0288218 A1 Nov. 18, 2010

Related U.S. Application Data

(63) Continuation-in-part of application No. PCT/EP2008/008845, filed on Oct. 18, 2008.

(30) Foreign Application Priority Data

Nov. 22, 2007 (DE) ..... 10 2007 056 337

(51) Int. Cl.
*F01L 1/34* (2006.01)

(52) U.S. Cl. ..... 123/90.18; 123/90.6; 29/888.1; 74/569

(58) Field of Classification Search ..... 123/90.18, 123/90.6, 90.44; 29/888.1; 74/569
See application file for complete search history.

(56) References Cited

U.S. PATENT DOCUMENTS

| | | | | |
|---|---|---|---|---|
| 4,516,542 | A | 5/1985 | Aoyoma et al. | |
| 7,963,261 | B2 * | 6/2011 | Mock et al. | 123/90.39 |

FOREIGN PATENT DOCUMENTS

| | | |
|---|---|---|
| DE | 42 30 877 | 4/1993 |
| DE | 10 2005 003 079 | 8/2006 |
| DE | 10 2005 033 018 | 1/2007 |

* cited by examiner

*Primary Examiner* — Ching Chang
(74) *Attorney, Agent, or Firm* — Klaus J. Bach

(57) ABSTRACT

In a valve drive arrangement for an internal combustion engine including a camshaft carrying axially movable cam elements provided with cams for operating gas exchange valves of the internal combustion engine and an actuation device having at least one shift element which is provided to shift cam element by means of a shifting gate between opposite axial positions, the valve drive arrangement has a change-over device for changing the axial shift direction of the shift element from one to the opposite axial position.

13 Claims, 6 Drawing Sheets

VALVE DRIVE DEVICE

This is a Continuation-in-Part application of pending international patent application PCT/EP2008/008845 filed Oct. 18, 2008 and claiming the priority of German patent application 10 2007 056 337.1 filed Oct. 22, 2007.

BACKGROUND OF THE INVENTION

The invention relates to a valve drive arrangement including a camshaft with a cam element axially movably disposed on the camshaft and with an actuation device including a shift element and a cooperating shift gate for axially shifting the cam element disposed on the camshaft.

Valve drive devices, in particular of an internal combustion engine, with an actuation device which has at least one shift element, which is provided to shift at least one cam element by means of a shift gate are known in the art.

It is the object of the present invention to provide a valve drive arrangement with a relatively small number of actuation structures.

SUMMARY OF THE INVENTION

In a valve drive arrangement for an internal combustion engine including a camshaft carrying axially movable cam elements provided with cams for operating gas exchange valves of the internal combustion engine and an actuation device having at least one shift element which is provided to shift cam element by means of a shifting gate between opposite axial positions, the valve drive arrangement has a change-over device for changing the axial shift direction of the shift element from one to the opposite axial position.

The valve drive arrangement includes a change-over device which is provided for changing over a shift direction of the shift element. A second shift structure is thereby not needed so that the number of actuators is reduced in particular and installation space and installation costs can be saved. A "shift direction" means a direction in which the cam element can be shifted by means of the shift element.

It is further suggested that the change-over device includes a change-over sleeve. A particularly simple and compact change-over device can be realized by means of such a change-over sleeve.

The change-over sleeve advantageously has at least two change-over units for changing the shift directions.

If the change-over sleeve can further be rotated with regard to the cam element in at least one operating mode, one can change over in a simple manner between the two shift directions.

The change-over sleeve is preferably arranged in a torque-proof manner with regard to the cam element in at least one operating mode. A shift device can thereby be adjusted, whereby a shift direction of the cam element can be defined for the shifting process.

It is further suggested that the change-over units are offset with regard to each other in the circumferential direction. The shift direction can thereby be defined in a simple manner by a position of the shift sleeve.

The change-over units preferably are offset by an angle of about 180°. The circumference of the shift sleeve can thereby be utilized in a particularly advantageous manner.

It is further suggested that the change-over device has a brake element, which is provided to provide a change-over force. The rotational movement of the cam element for rotating the shift sleeve and thereby for choosing a shifting direction can thereby be used in a particularly simple manner. A "brake element" is an element which hinders a rotational movement of the shift sleeve and thus provides a force for a relative rotation of the shift sleeve, especially with regard to the cam element. However, another device can alternatively also be used for rotating the shift sleeve relative to the cam element as for example a device with hydraulic and/or electrical actuators.

It is also suggested that the change-over device has a change-over unit, which is connected to the cam element in a torque-proof manner. The shift sleeve can thereby be coupled to the cam element in a simple manner, wherein the shift sleeve and the cam element can especially be coupled for an axial movement.

The actuation device preferably has a gate with two adjusting segments. The valve drive device can be axially particularly compact, wherein an arrangement with exactly one gate path is especially advantageous.

If the adjusting segments have different axial direction components, two axial shift directions of the cam element can be provided in an advantageous manner.

The actuation device preferably has a shift sleeve with two shift units. The cam element can thereby be moved axially in two shift directions, wherein the shift units are preferably arranged offset by 180° and are connected directly to the change-over units.

In a particularly advantageous arrangement of the invention, the change-over device and the actuation device are designed at least partly in one piece. The number of components and the installation costs can thereby be reduced further.

In another advantageous embodiment, the actuation device has a second shift element, which is provided to shift at least a further cam element by means of a further shift gate. The cam element which is shifted by means of the first shift element and the cam element which is shifted by means of the second shift element are preferably designed in a radially spaced manner. By means of such an arrangement, cam elements of different camshafts can be shifted, as for example cam elements of an input camshaft and cam elements of an output camshaft by means of the actuation device, which preferably only has one actuator.

The invention will become more readily apparent from the following description of a particular embodiment thereof on the basis of the accompanying drawings.

DESCRIPTION OF A PARTICULAR EMBODIMENT

Figure 1:
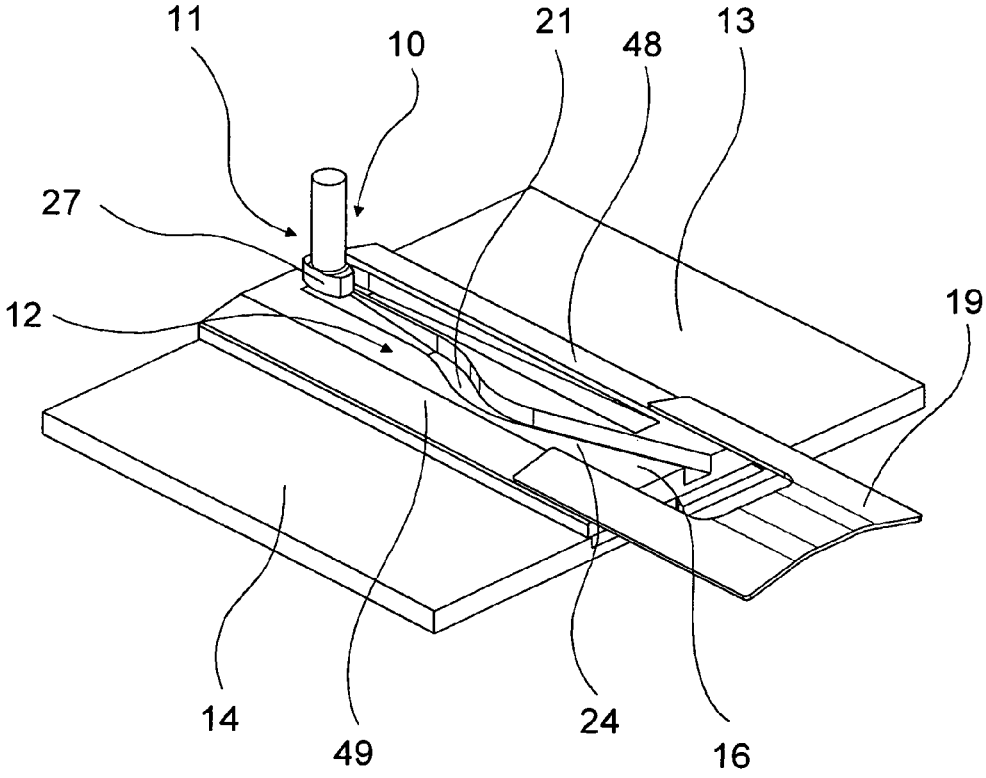
FIG. 1 shows a section of a valve drive arrangement with shift element in a planar view seen from above.
Figure 9:
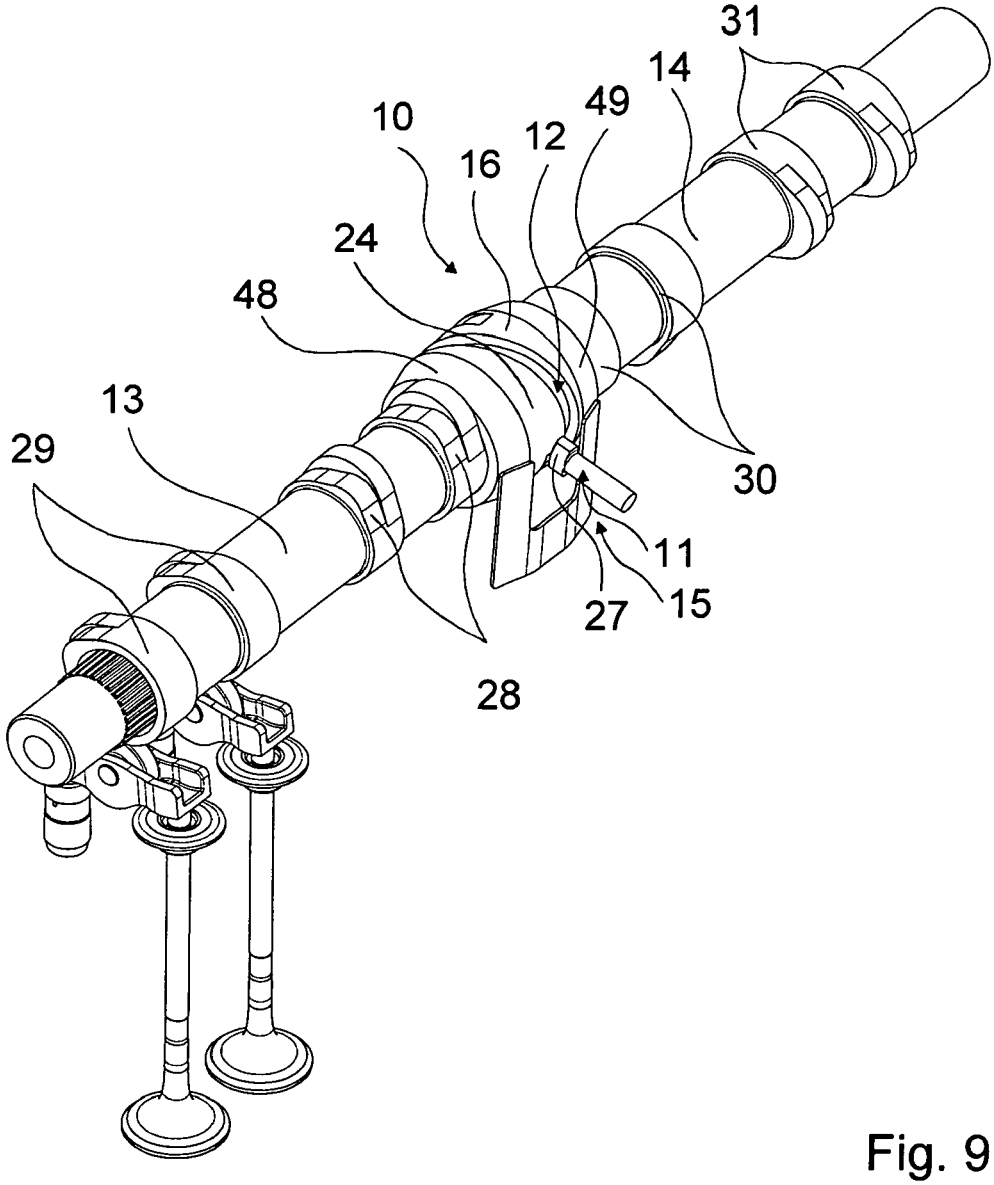
FIG. 9 shows the entire valve drive arrangement in a perspective view.

FIG. 1 shows a section of a valve drive arrangement with a shift element 11 of an actuation device 10. The shift element 11 has an actuation pin 27 which can engage a shift gate 12. In an operating mode, in which the shift element 11 engages the shift gate 12, two cam elements 13, 14 are axially moved by means of the switching gate 12, whereby a changeable valve drive can be realized. The cam elements 13, 14 respectively have four cam pairs 28, 29, 30, 31 (FIG. 9).

The cam elements 13, 14 in FIGS. 1 to 8 are shown in a developed planar view for a simplified depiction. A perspective depiction, where the cam elements 13, 14 have a curvature and a closed surface in themselves, is shown in FIG. 9. The shift gate 12 of the actuation device 10 has exactly one gate path 21 by means of which the cam elements 13, 14 can be moved axially in two shift directions. In order to change over the shift direction in which the switching element 11 moves the cam elements 13, 14, the valve drive arrangement has a change-over device 15 with a change-over sleeve 16.

In an operating mode, in which the shift direction is to be changed over, the change-over sleeve 16 can be rotated against the cam elements 13, 14. In an operating mode, in which the cam elements 13, 14 are to be shifted by means of the actuation device 10, the change-over sleeve 16 is arranged in a torque-proof manner to the cam elements 13, 14.

In order to arrange the change-over sleeve 16 in two shift positions in a torque-proof manner to the cam elements 13, 14, the change-over sleeve 16 has two change-over units 17, 18 by means of which the change-over sleeve 16 can be arranged in a torque-proof manner to the cam elements 13, 14. The change-over units 17, 18 are thereby offset to each other in the circumferential direction and thereby have an offset angle of 180°. The change-over units 17, 18 engage a further change-over unit 20, which is arranged in a torque-proof manner on the cam elements 13, 14.

Figure 2:
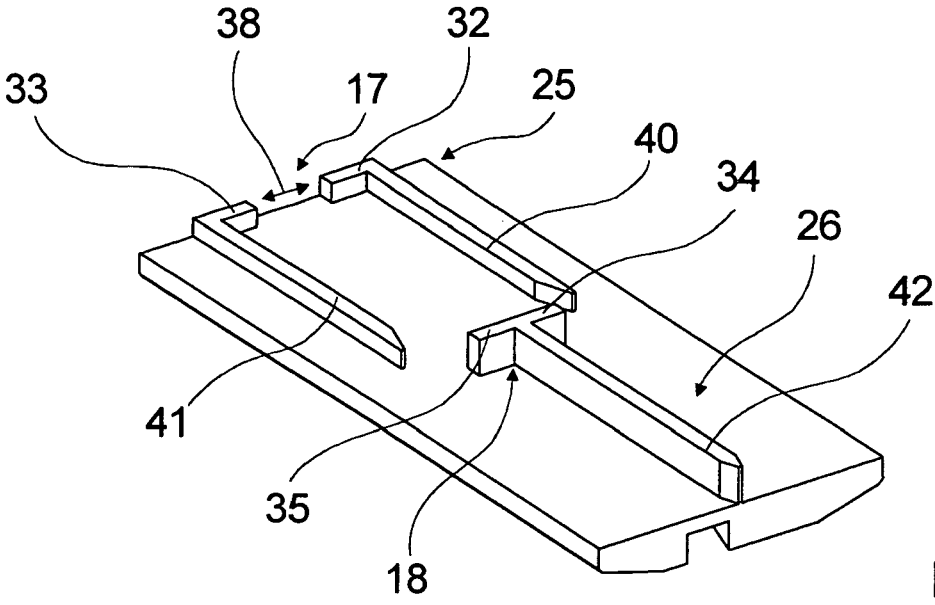
FIG. 2 shows a shift and change-over sleeve designed in one piece in a first planar view from above.
Figure 3:
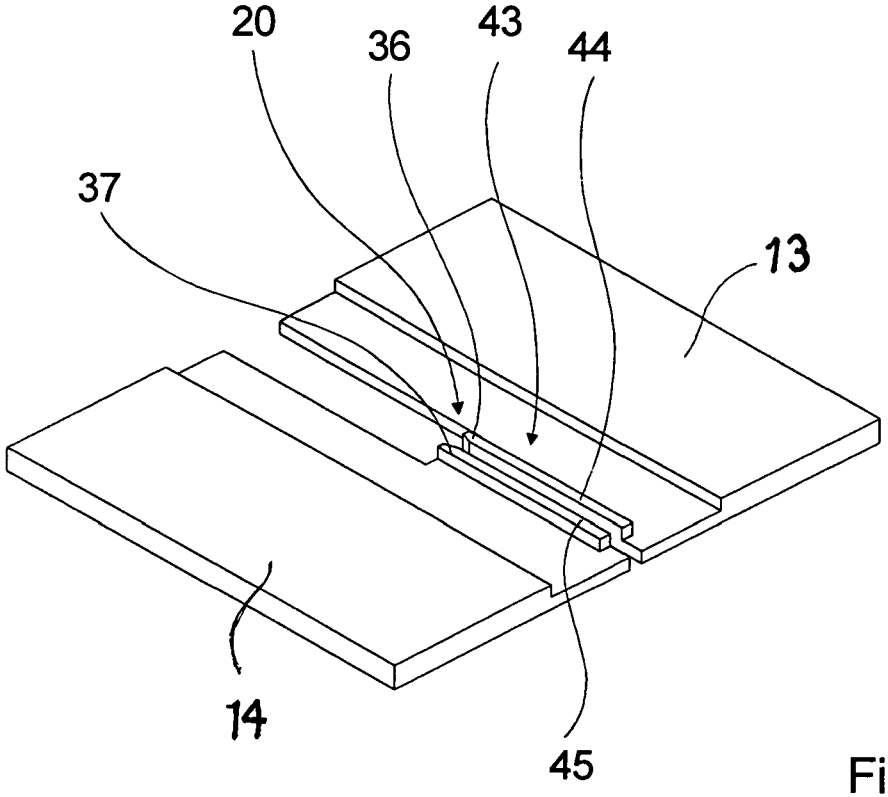
FIG. 3 shows the shift and change-over sleeve designed in one piece in a second planar view from above.

The two change-over units 17, 18 of the change-over sleeve 16 have elevations 32, 33, 34, 35, which are arranged on a lower side of the change-over sleeve 16 opposite the shift element 11 (FIG. 2). The change-over unit 20, which is designed in a torque-proof manner with the cam elements 13, 14 has two elevations 36, 37, which are arranged on the cam elements 13, 14 (FIG. 3).

The elevations 32, 33 of the first change-over unit 17 of the change-over sleeve 16 are formed in two parts, which extend axially on the change-over sleeve 16. The elevations have a spacing 38 in the axial direction. The elevations 34, of the second change-over unit 18 of the change-over sleeve 16 are formed in one piece. They extend axially and have a width which is essentially the same as an axial width of the spacing 38 between the elevations 32, 33 of the first change-over unit 17. The elevations 33, 34 of the second change-over unit are axially arranged at the height of the spacing 38 and are circumferentially offset by 180° with respect to elevations 32, 33 of the first change-over unit 17.

The elevations 36, 37 of the third change-over unit 20, which are arranged on the cam elements 13, 14, have a form-fit contact with the elevations 32, 33 of the first change-over unit 17 in the first shifting position. The cam elements 13, 14 are moved radially outwardly starting from a center of the change-over sleeve 16. The elevations 36, 37 of the third change-over unit 20 have a form-fit contact with the elevations 34, 35 of the second change-over unit 18. The cam elements 13, 14 are moved radially in the direction of the center of the switching sleeve 16 in this switching position.

In order to switch from the first to the second switching unit, the elevations 36, 37 of the third change-over unit 20, which are arranged on the cam elements 13, 14, are moved axially inwardly, whereby the change-over sleeve 16 can rotate, as the elevations 36, 37 of the third change-over unit 20 then lie in the space 38 between the elevations 32, 33 of the first change-over unit 17. The change-over sleeve 16 then rotates by 180°, until the elevations 36, 37 of the third change-over unit 20 are in form-fit contact with the elevation 32, 33 of the first change-over unit 17.

In order to switch from the second to the first shift position, the elevations 32, 33 of the third change-over unit 20 are moved axially outwardly. The form-fit contact of the elevations 32, 33 of the third change-over unit 20 is thereby canceled with the elevations 34, 35 of the second change-over unit 18, and the change-over sleeve 16 again rotates by 180°, until the elevations 36, 37 of the third change-over unit 20 are in a form-fit contact with the elevations 32, 33 of the first change-over unit 17.

A change-over force, which rotates the change-over sleeve 16 relative to the cam elements 13, 14, is imparted by a brake element 19. The brake element 19 which is formed in the shape of a plate, has a friction-fit contact with the change-over sleeve 16. The brake element 19 is arranged in a torque-proof manner, the change-over unit 16 is rotated together with the cam elements 13, 14 of an internal combustion engine. By means of the friction-fit contact of the brake element 19 with the change-over sleeve 16, a force acts on the change-over sleeve, by means of which the change-over sleeve 16 can be rotated relative to the cam elements 13, 14, wherein a rotational direction is defined by a rotational direction of the cam elements 13, 14 or the shifting sleeve 16.

Figure 4:
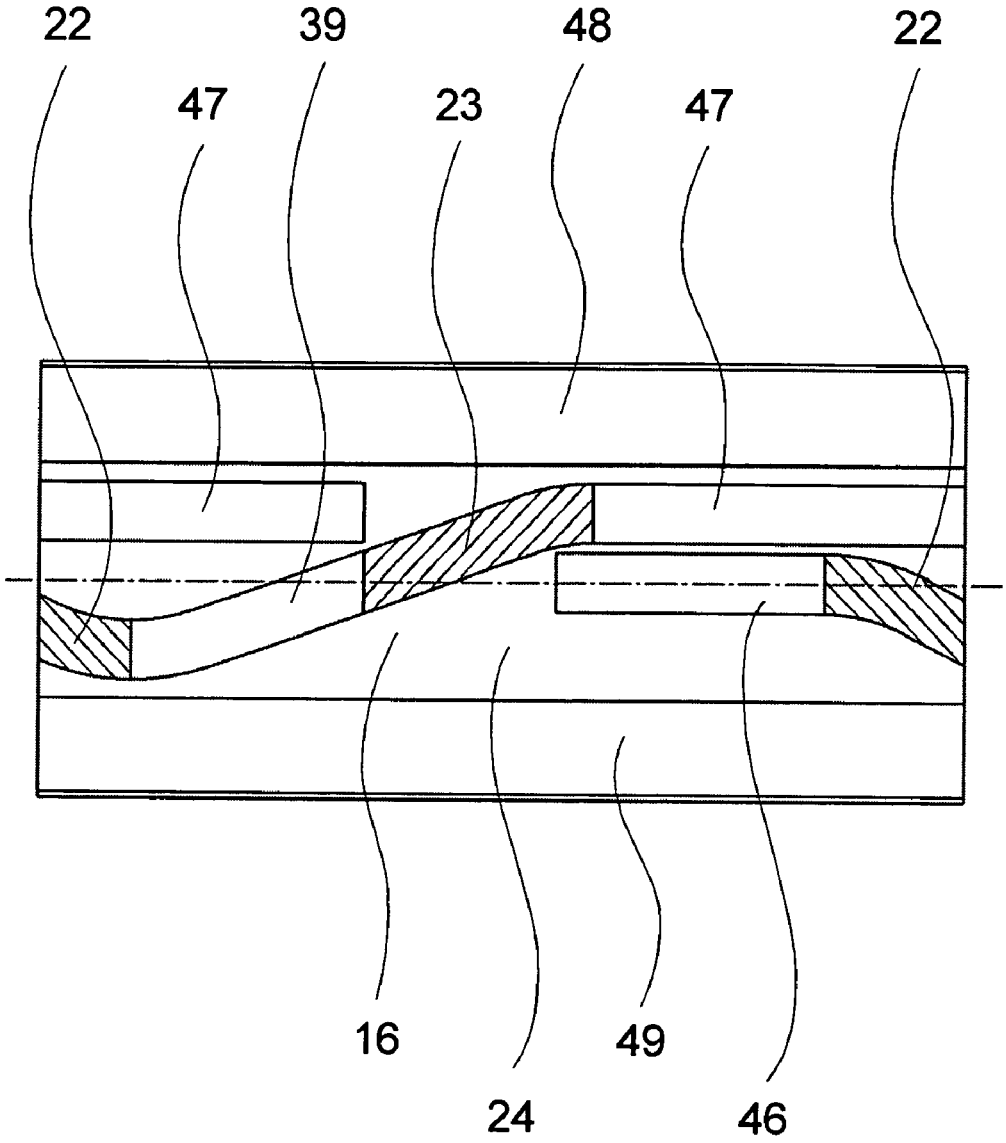
FIG. 4 shows a shift gate of the valve drive arrangement from above.

In order to displace the cam elements axially, the actuation device 10 has a shift sleeve 24, which is formed in one piece with the change-over sleeve 16. The switching sleeve 24 has a gate path 21 with two adjusting segments 22, 23, wherein the adjusting segments 22, 23 have different direction components. The adjusting segments 22, 23 are joined by an intermediate segment 29. A course of the gate path 21 can essentially be described by an S-shaped form (FIG. 4).

A first shift unit 25 and a second shift unit 26 are arranged at the bottom side of the shift sleeve 24. The first shift unit 25 has two elevations 40, 41, which are directly connected to the elevations 32, 33 of the first change-over unit 17. The elevations 40, 41 of the shift unit 25 essentially extend in the circumferential direction.

The second shift unit 26 has an elevation 42, which is offset in the circumferential direction by 180° to the elevations 40, 41 of the first switching unit 25. The elevation 42 of the second shift unit 26 is arranged axially in a center of the shift sleeve 24 and also extends in the circumferential direction.

A third shift unit 43 is arranged at the cam elements 13, 14, which unit has two elevations 44, 45 arranged at the cam elements 13, 14, which elevations are connected to the cam elements 13, 14. The cam elements are arranged on the camshaft in a torque-proof manner, but are axially movable.

If the change-over sleeve 16 and thus also the shift sleeve 24 are in the first shift position, the elevations 44, 45 of the third shift unit 43 are disposed axially between the elevations 40, 41 of the first shift unit 25. The elevations 40, 41 of the shift unit 25 and the elevations 44, 45 of the third shift unit 43 are thereby arranged immediately adjacent to each other.

Figure 5:
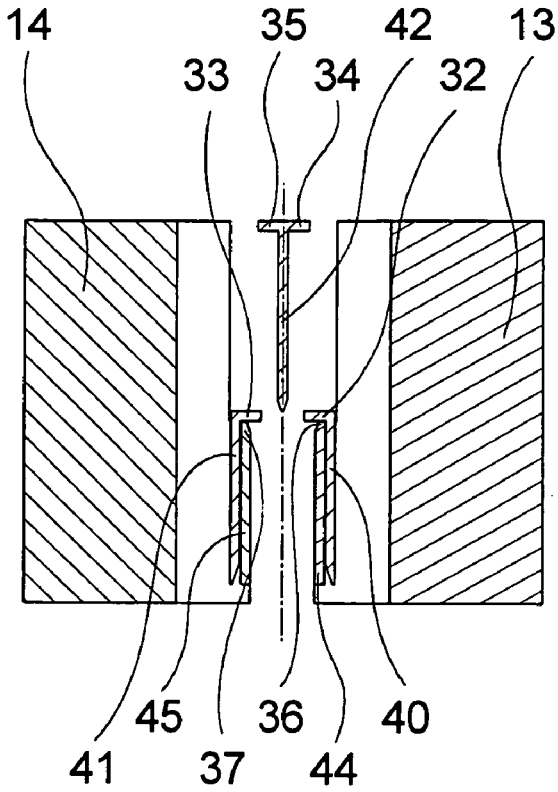
FIG. 5 shows the shift and change-over sleeve of the valve drive arrangement in a first shift position before a shift process from above.
Figure 6:
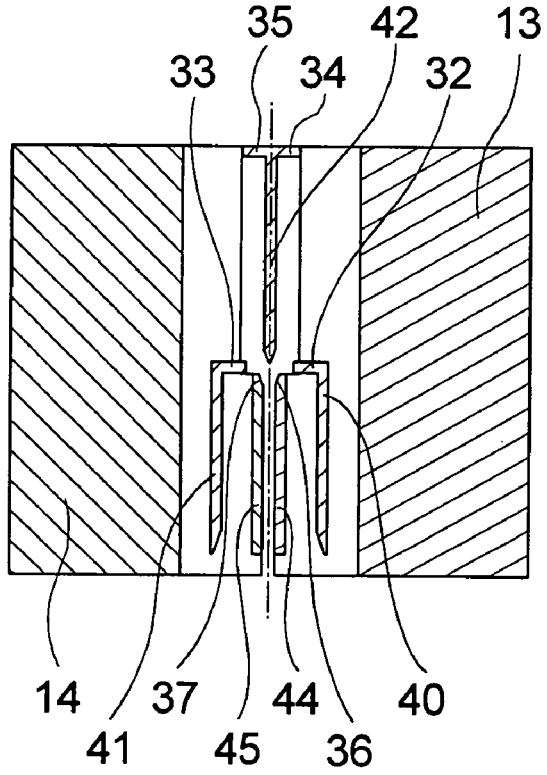
FIG. 6 shows the shift and change-over sleeve of the valve drive arrangement in the first shift position after a shift process from above.

If the shift element 11 has moved into the gate path 21 via an engagement segment 46 of the gate path 21, the shift sleeve 24 is axially moved away by the axial direction component of the first adjusting segment 22. The elevation 40 of the first shift unit 25 and the elevation 44 of the third shift unit 43 have a form-fit contact for such an axial movement. The first cam element 13 is thereby axially moved in the direction of the center of the shift sleeve 24. The second cam element 14 is subsequently also axially moved in the direction of the center of the shift sleeve 24 by the second adjusting element 23 and the contact of the elevation 41 of the first shift unit 25 with the elevation 45 of the third shift unit 43 is also axially moved in the direction of the center of the shift sleeve 24 (FIG. 5 and FIG. 6).

The shift element 11 subsequently again disengages from the gate path 21 via a disengagement segment 47. If the shift element 11 is disengaged, the shift sleeve 24 and thus also the change-over sleeve 16 is again reset to a center position between the cam elements 13, 14 by a reset force, which is exerted on the shift sleeve 24 by means of the brake element 19. The brake element 19 and the shift sleeve 24 or the change-over sleeve 16 have chamfers 48, 49 axially on the outside, which generate a force in the center position. Alternatively, other devices which generate a reset force, can also be provided.

The change-over sleeve 16 and thus also the shift sleeve 24 switch from the first shift position to the second shift position by the movement of the cam elements 13, 14, and thus the movement of the elevations 36, 37 of the third shift-over unit 20. In the second shift position, the elevation 42 of the second shift unit 26, which is arranged on the shift sleeve 24, is immediately between the elevations 44, 45 of the third shift unit 43, which are arranged on the cam elements 13, 14.

Figure 7:
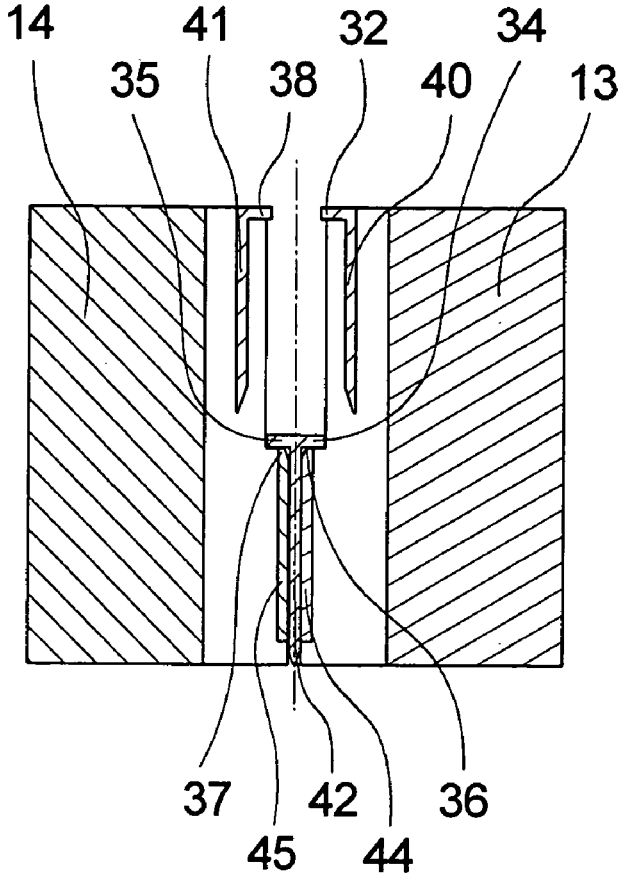
FIG. 7 shows the shift and change-over sleeve of the valve drive arrangement in a second shift position before a shifting process from above.
Figure 8:
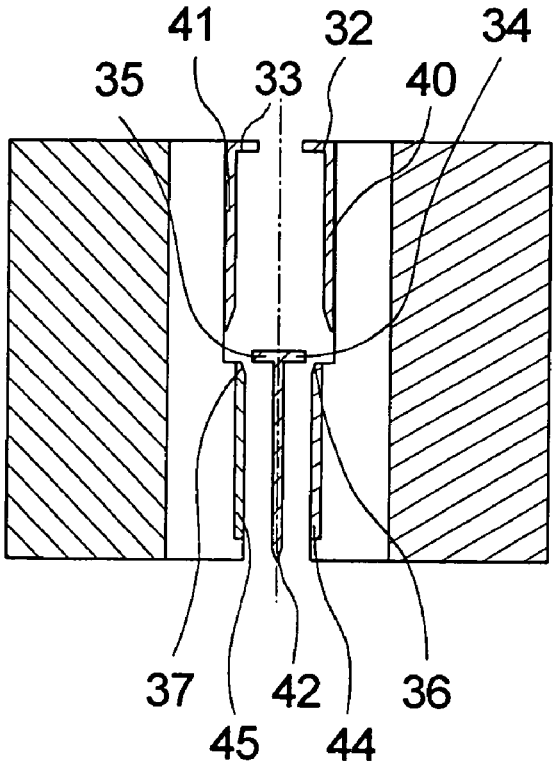
FIG. 8 shows the shift and change-over sleeve of the valve drive device in the second shift position after a shifting process from above.

If the shift element 11 engages the gate path 21 when the shift sleeve 24 is in the second shift position, the second cam element 14 is moved axially away from the center by the axial movement which the shift sleeve 24 carries out due to the first adjusting segment 22. Subsequently, the first cam element 13 is also moved axially outwardly by the second adjusting element 23. The elevation 42 of the second shift unit 26 and the elevations 44, 45 of the third shift unit 43 engage each other for such an axial movement of the shift sleeve 24, whereby the cam elements 13, 14 can be moved via the shift sleeve 24 (FIG. 7 and FIG. 8).

When the shift element 11 is again disengaged from the gate path 21 via the disengagement segment 47, the shift sleeve 24 is again moved into the center position via the brake element 19. The change-over sleeve 16 subsequently shifts again into the first shift position by the movement of the cam elements 13, 14 and the accompanying movement of the elevations 36, 37 of the third change-over unit 20.

The valve drive arrangement may have a second camshaft, which is arranged parallel to the first camshaft shown in FIG. 9. The second camshaft is preferably designed like the first camshaft and also has two cam elements with four cam pairs. With such an embodiment, the actuation device is preferably arranged between the camshafts, whereby two shift elements with two actuation pins can be actuated by means of one actuator, which can then engage the shift gates. of the individual shift or change-over sleeves. A shift device for a valve drive device of a multi-cylinder internal combustion engine can thus be provided by means of only one actuator, which provides a shiftable valve drive for the gas inlet and gas outlet valves of the internal combustion engine.

What is claimed is:

1. A valve drive arrangement for an internal combustion engine with a camshaft including axially movable cam elements (13, 14) carrying cams for operating gas exchange valves of the engine with an actuation device (10) which has at least one shift element (11) with shift gates (12) for shifting at least one of the cam elements (13, 14) between opposite axial positions and a change-over device (15) for changing a shift direction of the shift element (11).

2. The valve drive device according to claim 1, wherein the change-over device (15) includes a change-over sleeve (16).

3. The valve drive device according to claim 2, wherein the change-over sleeve (16) has at least two change-over units (17, 18).

4. The valve drive device according to claim 3, wherein the change-over units (17, 18) are offset relative to each other in the circumferential direction.

5. The valve drive device according to claim 4, wherein the change-over units are offset circumferentially by an angle of about 180°.

6. The valve drive device according to claim 2, wherein, in at least one operating mode, the change-over sleeve (16) is rotatable with regard to the cam element (13, 14).

7. The valve drive device according to claim 2, wherein, in at least one operating mode, the change-over sleeve (16) is arranged in a rotationally fixed manner relative to the cam element (13, 14).

8. The valve drive device according to claim 1, wherein the change-over device (15) has a brake element (19), which is provided to provide a change-over force.

9. The valve drive device according to claim 1, wherein the change-over device (15) has a change-over unit (20) which is connected to the cam element (13) in a rotationally fixed manner.

10. The valve drive device according to claim 1, wherein the actuation device (10) has a gate path (21) including two adjusting segments (22, 23).

11. The valve drive device according to claim 10, wherein the adjusting segments (22, 23) have a different axial direction component.

12. The valve drive device according to claim 1, wherein the actuation device (10) has a shift sleeve (24) with two shift units (25, 26).

13. The valve drive device according to claim 1, wherein the change-over device (15) and the actuation device (10) are designed at least partly in one piece.

* * * * *